US006354365B2

(12) United States Patent
Capotosti et al.

(10) Patent No.: US 6,354,365 B2
(45) Date of Patent: Mar. 12, 2002

(54) METHOD FOR THE CONTINUOUS CASTING OF THIN METAL PRODUCTS, AND APPARATUS FOR CARRYING OUT THE SAME

(75) Inventors: Romeo Capotosti, Narni; Riccardo Tonelli; Pietro Tolve, both of Rome, all of (IT)

(73) Assignees: Acciai Speciali Terni S.p.A., Terni (IT); Voest-Alpine Industriean Lagenbau GmbH, Linz (AT)

( * ) Notice: Subject to any disclaimer, the term of this patent is extended or adjusted under 35 U.S.C. 154(b) by 0 days.

(21) Appl. No.: 09/214,912

(22) PCT Filed: Jul. 9, 1997

(86) PCT No.: PCT/IT97/00161

§ 371 Date: Apr. 2, 1999

§ 102(e) Date: Apr. 2, 1999

(87) PCT Pub. No.: WO98/02264

PCT Pub. Date: Jan. 22, 1998

(30) Foreign Application Priority Data

Jul. 16, 1996 (IT) ..... RM96A0506

(51) Int. Cl.[7] ..... B22D 11/06
(52) U.S. Cl. ..... 164/480; 164/428
(58) Field of Search ..... 164/428, 480, 164/452, 451

(56) References Cited

U.S. PATENT DOCUMENTS 5,201,362 A * 4/1993 Yamagami et al. ..... 164/480
5,490,555 A * 2/1996 Korpela ..... 164/454

FOREIGN PATENT DOCUMENTS

| | | | | |
|---|---|---|---|---|
| EP | 0546206 | | 6/1993 | |
| EP | 0692330 | | 1/1996 | |
| EP | 0698433 | | 2/1996 | |
| FR | 2628993 | * | 7/1989 | ..... 164/428 R |
| FR | 2628993 | | 9/1989 | |
| JP | 63-115653 | * | 5/1988 | |
| JP | 63-177944 | * | 7/1988 | |

* cited by examiner

*Primary Examiner*—M. Alexandra Elve
*Assistant Examiner*—Liza Pacheco

(57) ABSTRACT

A method for continuously casting thin metal products, the method comprising the operations of pre-heating a pair of refractory plates (7) for the lateral containment of a bath of molten metal constituted of a pair of counter-rotating rolls (1, 2) and of abutting said pair of plates (7) towards each lateral surface of the ends of said pair of rolls (1, 2), characterized in that it comprises the operations of applying a controlled elastic or elastic/plastic deformation to said pair of plates (7) at the contacting arc between the surface of the plates (7) and the peripheral portion of the ends of said rolls (1, 2), and controlling said elastic and/or elastic-plastic deformation of said pair of plates (7) during the whole casting process, so as to minimize the surface wear of the plates (7) and of the ends of the rolls (1, 2), and to guarantee the maintainment of a predetermined distance between said rolls (1, 2) and said plates (7) lower than a predetermined value, and to minimize the occurrence of leaks-of molten metal between said plates (7) and said end parts of said rolls (1, 2).

9 Claims, 2 Drawing Sheets

MODEL
DATA ENTRY DEVICE
CONTROL UNIT

METHOD FOR THE CONTINUOUS CASTING OF THIN METAL PRODUCTS, AND APPARATUS FOR CARRYING OUT THE SAME

BACKGROUND OF THE INVENTION

The present invention relates to a process for the continuous casting of thin metal products and to an apparatus for carrying out the same, and, more in particular to an improved continuous casting method and to an apparatus suitable for carrying out such method, of the kind constituted of two counter-rotating rolls.

Apparatus with counter-rotating rolls for performing continuous casting of metal strips are already known in the state of the art. By means of these apparatus it is possible to jump from the conventional technology—for obtaining flat products with a thickness ranging from 150 mm to 250 mm, that generally are subjected to a further hot rolling and possibly a subsequent cold rolling, to the so-called "strip casting" technology. Such technology allows to obtain flat or strip products having a thickness lower than 10 mm, that subsequently can be hot/cold rolled.

Recently, the abovesaid technologies have been utilised for the production of steel strips. In particular, according to the more widespread "Strip Casting" technology i.e. the so-called "Twin Rolls," technology, there is provided for the casting of molten metal, such as steel, in a molten bath defined by a pair of counter-rotating rolls, which are cooled at their interior, and which have their longitudinal axes parallel and arranged horizontally, spaced each-other by a distance substantially corresponding to that of the cast strip, and a pair of containment side walls or dams made of a refractory material, that are placed in contact with the end surfaces of said rolls.

The sliding contact between the side walls or dams and the rolls must guarantee the absence of leaks of molten metal between them. This entails that said side walls or dams and the end surfaces of the rolls are subjected to particularly severe operating conditions.

Appreciable thermal deformations that modify the initial geometry of the side walls or dams are caused by a pre-heating that is carried out at two moments: i.e. before their abutting against the end faces of the rolls and after their abutting during the start operations before the actual steady-state casting.

The need of such pre-heating derives from the need of reducing to a minimum the likelihood that on the side walls or dams a undesired solidification of steel might occur, that if caught between the rolls, would cause unacceptable defects on the strip and damages to the side walls themselves.

Moreover, also the rolls are subject to thermal deformation during the casting, both in their radial and axial directions, which modify the shape of their end faces which contact the side walls, It derives therefrom that at room temperature the two surfaces, i.e. the ones of the side walls and the ones Of the end faces of the rolls, lie in a same plane, whereas such condition is lost during the initial transient and during the casting, This entails the build-up of gaps along the coupling areas of the two surfaces with consequent leaks of metal.

A leak or spilling of metal produces consequently detects along the edges of the strip products and unevenness in carrying out the process that can lead, in the most severe cases, to a stop of the plant.

The mating surfaces of the side walls and of the end faces of the rolls are moreover subject to wear owing to their relative motion and to the abutment pressure.

Such wear reduces the useful life of the components, and increases he costs; and it is greater with the increase of the contact forces applied for maintaining the mating of said surfaces.

To the end of overcoming such inconveniences, various contrivances have been developed. As an example in the Published European Patent Applications No 546 206 and 698 433, there is disclosed that the side walls are brought in abutment with the end faces of the rolls as a rigid body, and each side wall is supported on its back by a metal plate whereon pushing forces are applied, forces that then are distributed on the whole surface of the side wall. The side wall or dam pushed in this way against the end faces of the rolls, is subjected to a wear of the parts contacting the end faces of the rolls and therefore to a forward shift of the whole side wall up to when the whole sliding surface of the side wall or dam has reached the same contour of the opposing surface of the end face of the roll, trying in this way to guarantee a seal against penetration and leaks of molten steel.

These methods are however subject to the following inconveniences:

a)the pushing force is initially localised only on the contact areas between the side wall and the surface of the end faces of the rolls, with local values of the pressure that cannot be determined in advance and that can be very high, leading possibly the fracture of the refractory material as well as a relevant wear of the same;

b)a certain time is needed so that the surface of the side wall wears and consequently matches the surface of the end face of the roll (for instance in the European Patent Application No 546 206 above referred to, a time ranging from 0.5 to 1 minutes is mentioned before starting the casting operations).

Consequently the side walls are brought in abutment with the end faces of the rolls after the pre-heating step, with a consequent decrease of the temperature of the side wall or dam because the end surfaces of the rolls are usually cooled. It derives therefrom that such step must be as short as it is possible in order to avoid an excessive cooling of the side wall, because this would lead to solidification of the molten steel on the surface of the same;

c)during the initial steps of the casting, the contact of the molten steel with the rolls and with the side walls leads to a very fast deformation of these bodies and of the abutting surfaces. Such deformation impairs the matching between the surface of the end face of the rolls and the surface of the side walls. It is therefore necessary to wait again the wear of the surfaces of the side walls up to reach a new contour that allows the matching thereof;

d)the use of refractory side walls supported in their back by a metal plate renders very difficult the heating of the side walls from a surface opposite to the one that contacts the molten steel. It derives therefrom that these side walls must be heated from the interior of the space destined to contain the molten steel by means of a device that must be retracted before the starting of the casting (see European Patent Application No 698 433 A1). During the time span between the retraction of the heating device and the start of the casting of the steel, the side walls are subject to cooling. Moreover no mention is made of the possibility of heating the side wall (s) during the casting process. This increases risks of undesired solidification of steel on the side walls and a possible damage of the same.

Consequently, notwithstanding the improvements brought forth in this field, the problems of the confinement of the molten metal in the casting cavity, and of the undue wear of the side walls, and of the quality of the edges of the cast strip, and indeed the stopping of the continuous casting process, are largely still unresolved.

BRIEF SUMMARY OF THE INVENTION

The object of the present invention is therefore to reduce to a minimum the effects caused by the abovesaid problems by providing a method and apparatus for the continuous casting of thin material, improved according to the method disclosed hereinafter, in order to reduce the possibility of leaks of molten metal between the surface of the side walls or dams and the surfaces of the end face of the rolls, and at the same time to reduce the wear both of the surface of the side walls and the surface of the end faces of the rolls.

Another object of the present invention is to reduce greatly the amount of defects in correspondence with the edges of the cast product.

A still further object of the present invention is to reduce to a minimum the likelihood of stops in the continuous casting process, caused by leaks between the side walls and the end face of the rolls, as well as to reduce to a minimum the likelihood of the solidification of steel on the side walls.

According to the present invention, there is provided a method for the continuous casting of thin metal products, comprising the operations of pre-heating at least a pair of refractory plates for the lateral containment of a bath of molten metal constituted of a pair of counter-rotating rolls and arranged parallel each other and spaced for an amount greater than the sum of their radiuses and substantially corresponding to the thickness of the metal product, and of abutment of said at least a pair of plates towards each lateral surface of the ends of said pair of rolls, the method is characterised in that it comprises the following operations:

to apply a controlled deformation to said at least a pair of plates in correspondence with the contact arc between the surface of the plates and the peripheral portion of the ends of said rolls by means of thrust means contacting said plates, on the basis of data collected in advance and processed by means of a mathematical model representative of the behaviour of plates and rolls, with the same chemical-physical and dimensional characteristics of those utilised in the same experimental conditions; and controlling said deformation of said at least a pair of plates during the whole casting process by means of said thrust means and a control unit connected therewith, in order to mantain the surface wear of the plates and of the ends of the rolls within a minimum value, to maintain a distance between said rolls and said plates lower than a predetermined value, and to render minimum the occurrence of leaks of molten metal between said plates and said end parts of said rolls.

Further, the present invention provides an An apparatus for the improved continuous casting of thin metal products, comprising a pair of counter-rotating rolls arranged parallel each other at a distance greater than the sum of their radiuses and substantially corresponding to the thickness of said metal product, and a side containment device arranged on each lateral surface of each end of said pair of rolls, wherein said lateral containment device comprises a frame made of metal and a plate made of refractory material housed within said frame, and thrust means closely coupled to said frame on the back of the plate of refractory material and in register with the contact arc between said plate and the end faces of said rolls;

characterised in that said side containment device further includes:

heating means for said plate of refractory material rigidly arranged on said frame, in order to direct the heat onto the back surface of the plate;

means for detecting the deformation of said plates and associated to said thrust means; and in that it comprises a control unit having its input connected to a data entry unit and on its output connected to said pair of rolls and said side containment device.

In the apparatus according to the present invention, said thrust means comprises:

a plurality of ceramic cylinders;

a plurality of oil-pressure actuators fastened on said frame and coaxially with said ceramic cylinder; the arrangement being such so that for each and any displacement of said actuators there corresponds a displacement of the corresponding ceramic cylinder.

Further, in the apparatus according to the present invention, said heating means comprises at least a burner arranged on said frame, and so that it directs its flame onto the back surface of the plate of refractory material.

Further, in the apparatus of the present invention, said means for detecting the deformation of said plates are associated to said oil-pressure actuators, and are position transducers.

BRIEF DESCRIPTION OF THE DRAWING

The present invention will he better discussed hereinafter with reference to an embodiment thereof, given by way of non-limiting example, and with reference to the attached drawings, wherein.

DETAILED DESCRIPTION OF THE INVENTION

Figure 1:
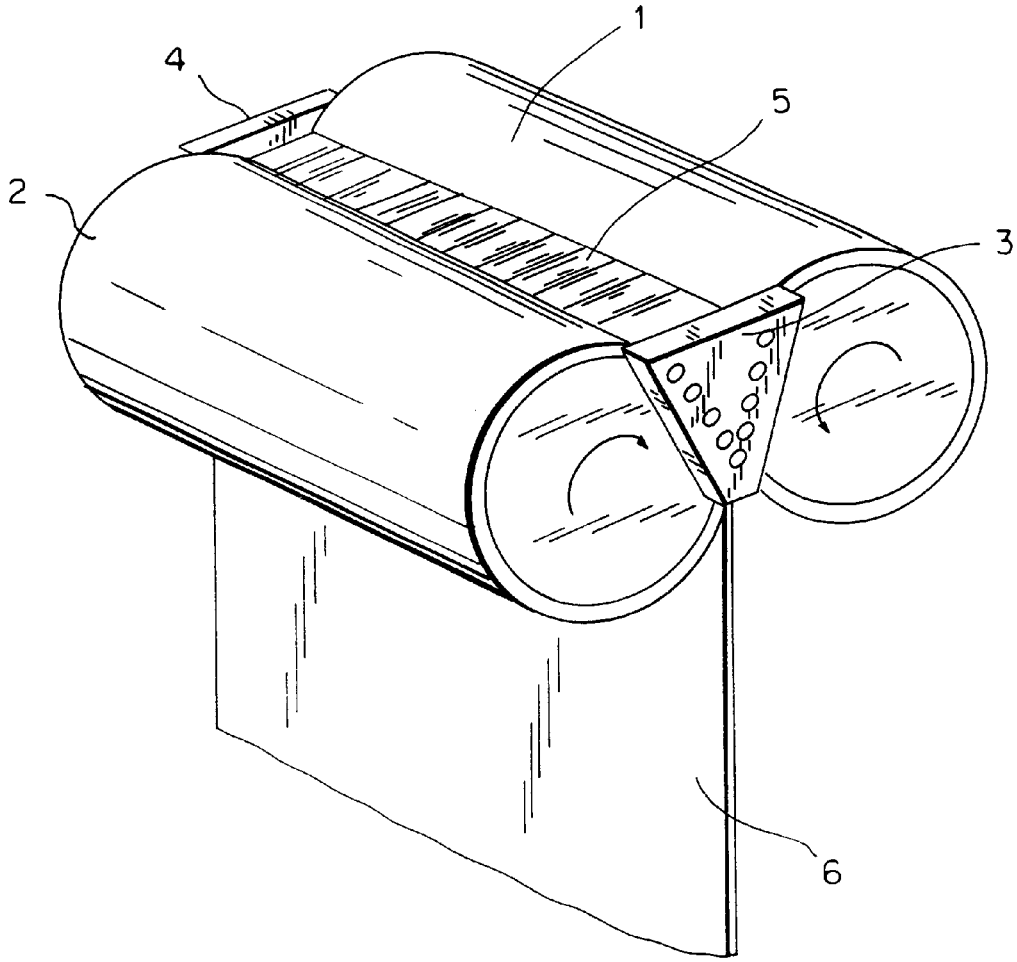
FIG. 1 is a perspective view of the apparatus according to the present inventions.

With reference to FIG. 1, the same shows schematically and in perspective the apparatus according to the present invention.

The apparatus comprises, in a conventional way, a pair of counter-rotating rolls 1 and 2 arranged parallel each other and spaced by an amount greater than the sum of their radiuses and substantially corresponding to the thickness of the cast product, and a pair of walls 3 and 4 acting as a side containment device (better disclosed hereinafter) arranged against the end faces of said rolls 1 and 2, respectively.

In this way there is formed a space defined between the rolls 1 and 2, and the walls 3 and 4, that can contain molten metal 5, that subsequently is solidified as a flat, strip product 6.

Figures 2, 3:
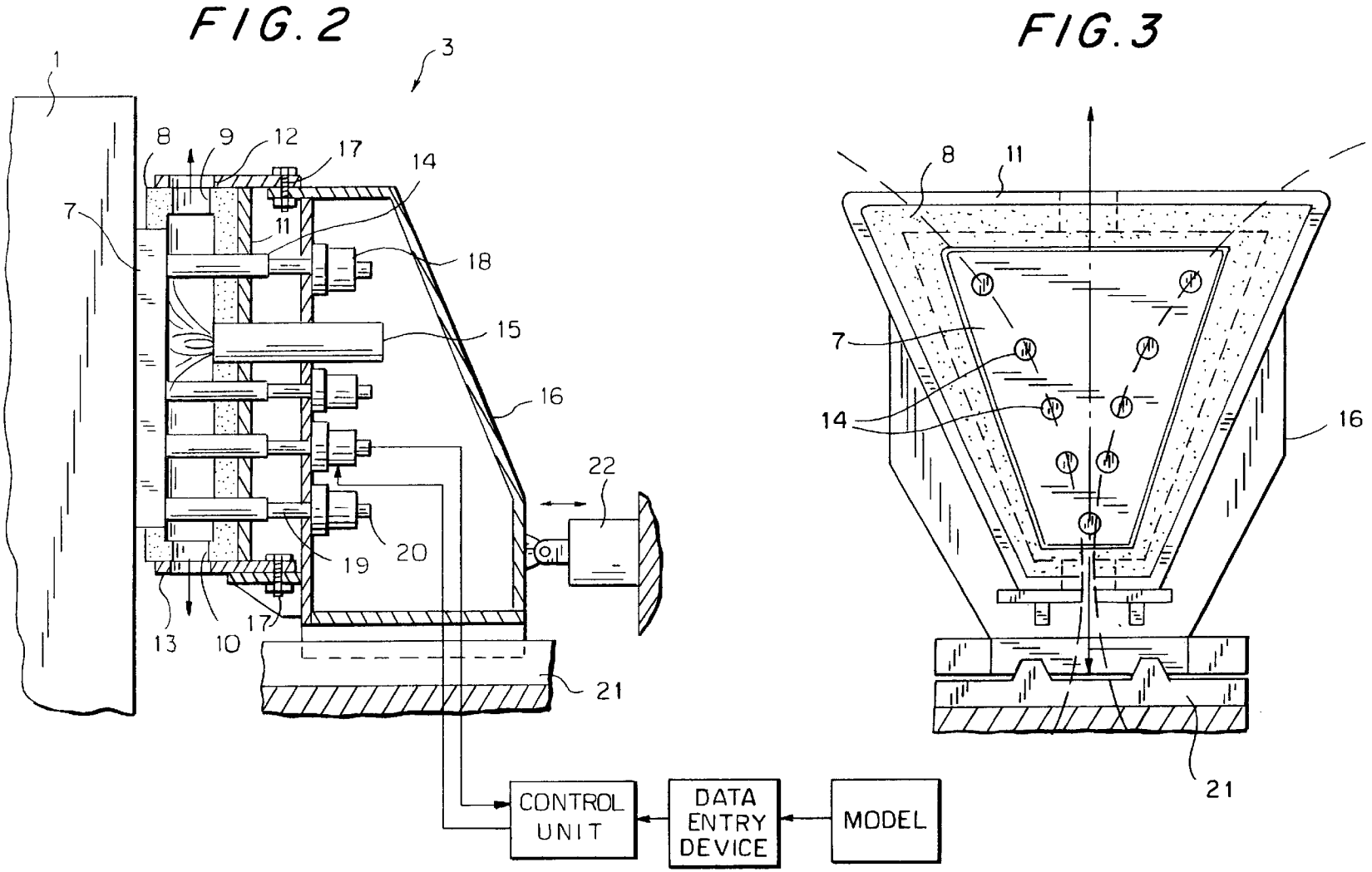
FIG. 2 is a cross-section schematic view of the side containment device according to the present invention.
FIG. 3 is a schematic front view of the side containment device shown in FIG. 2.

With reference to FIG. 2, there is shown a cross-section schematic view of the side containment device according to the present invention.

For sake of simplicity of disclosure only one of the side containment devices will be disclosed, thanks to the symmetry of the same.

The side containment device comprises a plate 7 of a refractory material such as, for instance, silicon carbide (SiC), that is placed into a supporting structure 8, such as, for instance a casting of silica-alumina. The arrangement is such so that the plate 7 is free to move within the structure a, parallel to the rotation axis of the rolls 1 and 2.

Said structure a is internally hollow and is provided with a pair of openings 9 and 10, arranged one on the top part, and the other on the bottom part, respectively. Said openings 9 and 10 are arranged for allowing to communicate with the exterior the internal cavity of the structure 8.

The structure 8, which houses as aforesaid the plate 7, is arranged in a first metal frame, which also is provided with an opening 12 in its top part and an give opening 13 in its bottom part, both the openings 12 and 13 being coincident with said openings 9 and 10, respectively.

Moreover, the frame 11 is arranged for receiving slidingly nine ceramic cylinders 14 (only four of the same have been shown in the figure), so that said cylinders 14 pass internally through the structure a and contact, with one of their ends, the internal face of the plate 7, and have their opposite end protruding out of the frame 11.

Further, said frame 11 carries a burner 15, that, passing through the structure 8 and protruding into the internal hollow part, is arranged to direct its flames onto the internal wall of the plate 7 and operates locally on the same up so that it reaches temperatures higher than 1000° C. By means of this arrangement, the combustion smokes of the burner are conveyed at the exterior through the two openings 9 and 10, respectively, and as it is shown with arrows in the figure.

The frame 11 assembled in this way is fastened to a second frame 16 by means of bolts 17. Said frame 16 is provided internally with nine oil-pressure cylinders 18 (of which only four are shown in the figure), which by means of their rods 19 contact said ceramic cylinders 14, thus transmitting to these latter their thrust force.

Moreover each actuator 18 is coupled to a position transducer 20. Each transducer 20 is arranged for sensing the local wear of the plate by making reference to the respective rod 19.

The frame 16 at its bottom is arranged slidably on a guide 21 so that this frame can be shifted horizontally, according to the arrow in the figure, and as a consequence of a respective displacement of a oil-pressure cylinder 22 fastened to said frame 16.

With reference to FIG. 3, this one shows a front view of the side containment device according to the present invention.

As it can be appreciated, the arrangement of the nine ceramic cylinders 14 and of the respective actuators 18 (schematically shown in the figure) is such, so that they operate against the plate 7 and the peripheral edge of the end faces of the rolls 1 and 2, respectively.

The whole of the thrust system of the actuators 18 against the walls 3 and 4, during the continuous casting process, is controlled by means of a control unit that, for simplicity, has not been represented in the figures because the same pertains to the state of the art.

Said control unit is arranged for receiving on its input, by means of a data entry device, all the necessary information as data obtained in advance through a mathematical model representative of plate and rolls having the same chemical and physical characteristics and under the same operating conditions as the real ones. Consequently, said control unit, once that said data have been processed, transmits these to the actuators and other ancillary equipment in order to obtain a system of locally variable thrusts both as magnitude and time, for the whole duration of the continuous casting process.

The thrust system is determined according to a method of mathematical computation based on the computation of finite elements for a given type of plate. Such method performs an analysis of the thermal and mechanical stresses on each plate and roll during the several steps of the process, i.e. during the steps o: pre-heating o the walls, abutment of the same against the rolls, beginning of the casting, and the casting under steady-state.

Moreover, the model has been adjusted by the local sensing of the temperatures on the plate, during ;-he whole process. By means of such analysis one may obtain a representation of the deformation of the plate for any thermal distribution obtained during the transients.

Subsequently a simulation can be made of the contact with the contour of the end face of the rolls, they too thermally deformed, obtaining in this way a representation of the deformation of the involved plate for assuring a seal against leaks of molten metal.

When the deformed contour of the plate has been obtained, by means of the iteration computation, being part of the state of the art, it is possible to determine the system or forces to be applied in the different steps to the back wall of the plate in order to obtain a contour that develops the greatest sealing action against the leaks of molten metal and the minimum of wear.

To this end a three-dimensional model is developed for evaluating the displacements along the whole arc of contact between plate and rolls The adopted convention is a reference frame of three right-angle axes: X, Y, Z, the origin of which lies in the point of minimum distance between the rolls (kissing point), the Z axis is parallel to the axis or the rolls and the Y axis belongs to the symmetry plane of the plate Herebelow, an illustrative example of an experimental realisation of a continuous casting process will be given, applying the computation method of the force system to the plate, obtained according to the above mentioned model.

EXAMPLE

Side containment devices have been utilised comprising plates of refractory material of silicon carbide (SiC) having a thickness of 35 mm along the contact arc between rolls and plate.

Moreover counter-rotating rolls have been utilised having he following characteristics:

| | |
|---|---|
| width of the rolls | 800 mm |
| diameter of the rolls | 1500 mm |
| external mantle of the rolls | Cu alloy |
| max peripheral speed | 100 m/min. |

The internal surface of the rolls is cooled by means of forced circulation of water.

In order to perform computations and processing operations on the model a finite elements computing code has been utilised (ANSYS). For the three-dimensional schematization of the meshes of the model there have been utilised the elements of the computing code ANSYS SOLID 70 for the thermal computations, SOLID 45 and CONTACT 49 for the thermal and mechanical computations.

Subsequently, the plates have been heated at 1200° C. before starting the casting process and the heating on the back face has been maintained for the whole process.

From the processing of the mathematical method the following force systems have been applied to the walls:

a)After 10 seconds since the abutment step on the back wall of the plate the following forces have been applied:

F=120 $kg_f$ in correspondence with the lower area;

F=60 $kg_f$ in correspondence with the top area; and

F=120 $kg_f$ in correspondence with the central area, thus obtaining the contact of the end face of the rolls between the ends of the plate and gaps of 0.07 mm in correspondence of the lower area and of 0.04 mm in correspondence of the central area.

b)during the casting step the following forces have been applied:

F=100 $kg_f$ in correspondence with the lower area;

F=100 $kg_f$ in correspondence with the top area; and

F=290 $kg_f$ in correspondence with the central area, thus obtaining the contact on the rolls or anyhow a distance between rolls and plate lower than 0.1 mm.

At the end of the process it has been determined that the amount of wear of the surfaces of the plates during the whole process has been of about 1 mm/km of strip; this indicates a dramatic reduction of the amount of wear with respect to the continuous casting processes for small thickness, that usually reach value of about 5 mm/km of cast strip.

What is claimed is:

1. A method for continuously casting a thin metal strip using a pair of counter-rotating rolls having end faces and a pair of refractory plates contacting the end faces of the rolls to provide side containment of a bath of molten metal provided between the rolls and from which the strip is cast, said method comprising:

prior to casting, producing a mathematical model based on dimensions and materials of the rolls and refractory plates and representative of the behavior of the rolls and refractory plates under given operating conditions, including the temperature distribution across each of the refractory plates, and calculating forces to be applied to press the refractory plates against the end faces of the rolls during casting under the given conditions, based on the mathematical model, in order to minimize wear of the end faces of the rolls and the refractory plates;

preheating the refractory plates; and carrying out the casting under the given operating conditions while pressing the refractory plates against the end faces of the rolls with forces that are controlled to correspond to the calculated forces, wherein said calculating operation calculates individual pressing forces to be applied to different areas of each refractory plate and said pressing operation is carried out to apply to each area of each refractory plate a force that is controlled independently of the forces applied to each other area of the plate, corresponding to the calculated individual pressing forces.

2. The method of claim 1 wherein said step of carrying out the casting is performed during the entire casting operation.

3. The method of claim 1 wherein said step of carrying out the casting comprises heating the refractory plates.

4. The method of claim 1 wherein said step of carrying out the casting comprises maintaining a distance of less than 0.1 mm between the end faces of the rolls and each refractory plate.

5. An Apparatus for continuously casting a thin metal strip, said apparatus comprising:

a pair of counter-rotating rolls having end faces that extend along arcs and a side containment device which includes a pair of refractory plates contacting the end faces of the rolls, the rolls and plates being arranged to contain a bath of molten metal from which the strip is cast;

data processing means providing a mathematical model based on dimensions and materials of the rolls and refractory plates and representative of the behavior of the rolls and refractory plates under given operating conditions, including the temperature distribution across each of the refractory plates, for calculating forces to be applied different areas of each refractory plate to press the refractory plates against the end faces of the rolls during casting under the given conditions, based on the mathematical model, in order to minimize wear of the end faces of the rolls and the refractory plates;

means for heating the refractory plates;

means for detecting deformations experienced by said refractory plates; and a control unit connected between said data processing means, said means for detecting deformations and said side containment device for carrying out the casting under the given operating conditions while pressing the refractory plates against the end faces or the rolls with forces that are controlled to correspond to the calculated forces, wherein said side containment device comprises a plurality of pressing devices responsive to control signals from said control unit for applying to each area of each refractory plate a force that is controlled independently of the forces applied to each other area of the plate, the forces being applied to said refractory plates along lines in register with the arcs along which the end faces of the rolls extend.

6. The apparatus of claim 5 wherein said side containment device comprises two frames each holding a respective refractory plate and a group of said pressing devices, and each of said pressing devices in each said frame comprises:

a ceramic cylinder for applying a pressing force to a respective refractory plate; and an oil pressure actuator fastened in said frame coaxially with said ceramic cylinder for applying a pressing force to, and displacing, said ceramic cylinder.

7. The apparatus of claim 6 wherein said means for detecting deformations are operatively associated with said actuators.

8. The apparatus of claim 7 wherein said means for detecting deformations are position transducers.

9. The apparatus of claim 5, wherein each refractory plate has a side which faces away from said rolls, and said heating means comprise two burners each mounted to direct a heating flame against the side of a respective refractory plate that faces away from said rolls.

* * * * *